US007992737B2

(12) United States Patent
Salice

(10) Patent No.: US 7,992,737 B2
(45) Date of Patent: Aug. 9, 2011

(54) SURPRISE CONTAINER

(75) Inventor: Giuseppe Salice, Arlon (BE)

(73) Assignee: Magic Production Group (M.P.G.) S.A., Senningerberg (LU)

( * ) Notice: Subject to any disclaimer, the term of this patent is extended or adjusted under 35 U.S.C. 154(b) by 273 days.

(21) Appl. No.: 12/093,466

(22) PCT Filed: Nov. 16, 2005

(86) PCT No.: PCT/IB2005/053792
§ 371 (c)(1),
(2), (4) Date: May 13, 2008

(87) PCT Pub. No.: WO2007/074355
PCT Pub. Date: Jul. 5, 2007

(65) Prior Publication Data

US 2008/0283539 A1 Nov. 20, 2008

(51) Int. Cl.
*B65D 41/00* (2006.01)
*B65D 43/00* (2006.01)
*B65D 41/32* (2006.01)

(52) U.S. Cl. ..... 220/4.23; 220/4.06; 220/4.07; 220/4.21; 220/4.22; 220/4.25; 220/265; 220/266; 220/834; 220/839; 215/235

(58) Field of Classification Search ..... 220/4.06, 220/4.07, 4.21, 4.22, 4.23, 4.25, 265, 266, 220/375, 788, 834, 838, 839; 215/235
See application file for complete search history.

(56) References Cited

U.S. PATENT DOCUMENTS

| | | | | |
|---|---|---|---|---|
| 2,998,896 A | | 9/1961 | Miller | |
| 3,043,354 A | | 7/1962 | Fitzgerald | |
| 3,907,103 A | | 9/1975 | Shaw | |
| 4,124,135 A | * | 11/1978 | Weder et al. | 220/4.21 |
| 4,403,712 A | | 9/1983 | Wiesinger | |
| 4,545,495 A | * | 10/1985 | Kinsley | 215/235 |

(Continued)

FOREIGN PATENT DOCUMENTS

DE 7436695 U 2/1975

(Continued)

*Primary Examiner* — Anthony Stashick
*Assistant Examiner* — Madison L Wright
(74) *Attorney, Agent, or Firm* — Rothwell, Figg, Ernst & Manbeck, P.C.

(57) ABSTRACT

Container for products, such as surprises or similar accessories, comprising two half-shells (2, 4), with a containing wall (2*a*, 2*b*; 4*a*, 4*b*) and with an open mouth (10, 12), able to be coupled together mouth-to-mouth so as to form a closed container (1), where the two half-shells (2, 4) are connected together by means of hinging means (20), with a hinging axis (a-a) such as to allow the movement of one of the, half-shells (2, 4) with respect to the other one between a closed position of the container (1) and an open position. The container (1), in its closed configuration, has a minimum overall dimension of between 20 mm and 55 mm and the containing wall (2*a*, 2*b*; 4*a*, 4*b*) of at least one of the half-shells (2, 4) has, in the vicinity of the hinging means (20), at least one line (44*a*/46*a*; 44*b*, 46*b*) with a weakened wall thickness, which extends over a section of said wall (2*a*, 2*b*; 4*a*, 4*b*) and which is capable of breakage following stresses applied to the body of the half-shell (2, 4) and/or to the hinging means (20) connecting the two half-shells (2, 4) and prone to cause breakage of said hinging means (20).

20 Claims, 7 Drawing Sheets

U.S. PATENT DOCUMENTS

| | | | | |
|---|---|---|---|---|
| 4,854,473 | A | 8/1989 | Dubach | |
| 5,417,339 | A * | 5/1995 | Liu | 220/315 |
| 5,730,310 | A * | 3/1998 | Yoshihara | 220/835 |
| 5,792,496 | A | 8/1998 | Fekete et al. | |
| 5,913,435 | A * | 6/1999 | Fuchs | 215/237 |
| 6,439,410 | B1 | 8/2002 | Dubach | |
| 6,460,712 | B2 * | 10/2002 | Smith et al. | 215/235 |

FOREIGN PATENT DOCUMENTS

| | | | |
|---|---|---|---|
| EP | 0331940 | A2 | 9/1989 |
| EP | 0720950 | A1 | 7/1996 |
| EP | 1308392 | A1 | 5/2003 |
| EP | 1529731 | A1 | 5/2005 |
| EP | 1604911 | A1 | 12/2005 |
| FR | 2869297 | A1 | 10/2005 |
| JP | 57-502163 | A | 12/1982 |
| JP | 2001-171711 | A | 6/2001 |
| WO | 9300267 | A1 | 1/1993 |

* cited by examiner

SURPRISE CONTAINER

CROSS REFERENCE TO RELATED APPLICATION(S)

This application is a 35 U.S.C. §371 National Phase Entry Application from PCT/IB2005/053792, filed November 16, 2005, and designating the United States the disclosure of which is incorporated herein in its entirety by reference.

The present invention relates to a container which is made of plastic, in particular intended to be used as a container for gift articles or surprises, such as toys or confectionary products, and is intended to be introduced inside a hollow body of a food product, such as a chocolate egg, or inside a packaging comprising a food product.

In particular, the invention refers to a container of the type comprising two half-shells which have a containing wall and an open mouth and can be coupled together mouth-to-mouth in a frontally engaging relationship so as to form a closed container and where the two half-shells are connected together by means of connecting means which comprise a hinging system which allows the tilting movement of one half-shell with respect to the other one between a closed position of the container and an open position.

The main object of the invention is that of providing a container in which the two half-shells forming, respectively, the bottom and the lid of the container are coupled together so as to avoid or in any case minimise the risk that stresses applied by the user to the connecting means and in particular to the hinging means may cause breakage thereof and the consequent separation of the two half-shells.

Another object of the invention is that of providing a container which achieves the abovementioned object, even though being made of a relatively inexpensive plastic material.

Another object of the invention is that of providing a container, the structure of which is such as to facilitate opening and closing of the said container by the user.

In view of these objects, the invention relates primarily to a container according to the preamble of claim 1, which is characterized in that—in its closed configuration—it has a minimum overall dimension of between 20 and 55 mm and in that the containing wall of at least one of the half-shells has, in the vicinity of the hinging means, at least one line with a weakened wall thickness, which extends over a section of said wall and which is capable of breakage or shearing following stresses applied to the body of the half-shell and/or to the hinging means connecting the two half-shells and prone to cause breakage of said hinging means.

Further characteristic features of the container are defined in the accompanying claims.

The basis of the invention consists in the idea of providing on the wall of one, or preferably, both the half-shells one or more preferential pre-incision lines prone to breakage before breakage or shearing of the hinging means which connect the two half-shells and where said one or more preferential pre-incision lines are arranged on the wall of one or both the half-shells so that any shearing thereof, produced by a stressing force, results in the presence of one or more incisions on the wall of the half-shell without causing separation of the half-shells which remain hinged together by means of the hinging means which remain intact.

According to the invention, the preferential pre-incision lines are preferably continuous lines with a weakened wall thickness, i.e. where the wall thickness is less than the wall thickness adjacent to these lines; thus, for example, the wall thickness of said lines is a film-like thickness, for example from 10 to 100 μm, while the wall thickness of the half-shells is in the region of 200-1000 μm. These weakened wall thickness lines are formed directly during moulding of the plastic half-shells.

In a preferred embodiment, one of the half-shells (or more preferably both the half-shells) has/have two continuous lines with a weakened wall thickness, each arranged on the opposite side of the means for connecting and hinging together the two half-shells, so that shearing of said lines causes the formation of a flexible tongue, providing a further possibility for hinging of the two half-shells.

Preferably, the container according to the invention is formed by a one-piece body where the two half-shells are connected together by means of connecting and hinging means integral with the two half-shells. Said hinging means may, for example, consist of film-like hinging means or snap film-like hinge elements, the latter for example being of the type described in U.S. Pat. No. 4,403,712.

However, the invention also embraces a container formed by two separate half-shells which are connected together by means of buckle or bayonet connecting means able to engage with each other, for example of the type described in EP-A-1 529 731.

Typically, the closed container has a generally elongated cylindrical shape, with curved top walls and with a circular or rounded mouth profile. In this case, the term "minimum overall dimension" is to be understood as referring to the mouth diameter or, in the case of a non-circular rounded mouth, to the minimum mouth diameter. Preferably, the abovementioned minimum overall dimension is between 30 mm and 45 mm.

Further characteristic features and advantages of the container according to the invention—and in particular its structural and functional advantages in relation to its use as a surprise container intended to be used and handled by children—will become apparent from the detailed description which follows, with reference to the accompanying drawings which are provided by way of a non-limiting example and in which.

With reference to the drawings, the container according to the invention, indicated in its entirety by 1, comprises a first and a second half-shell 2, 4 generally made of plastic and produced by means of injection-moulding.

The preferred materials are flexible plastics, preferably chosen from polyethylene, polypropylene homopolymer or copolymer, polyamide, polyethylene terephthalate (PET) and other thermoplastic polymers which can be injection-moulded.

In the examples of embodiment shown, each of the two half-shells 2, 4, has a general cup-like configuration with a containing wall comprising a dome-shaped terminal portion, optionally flattened at the top, 2*a* and 4*a*, and a skirt portion 2*b* and 4*b*.

Figure 5:
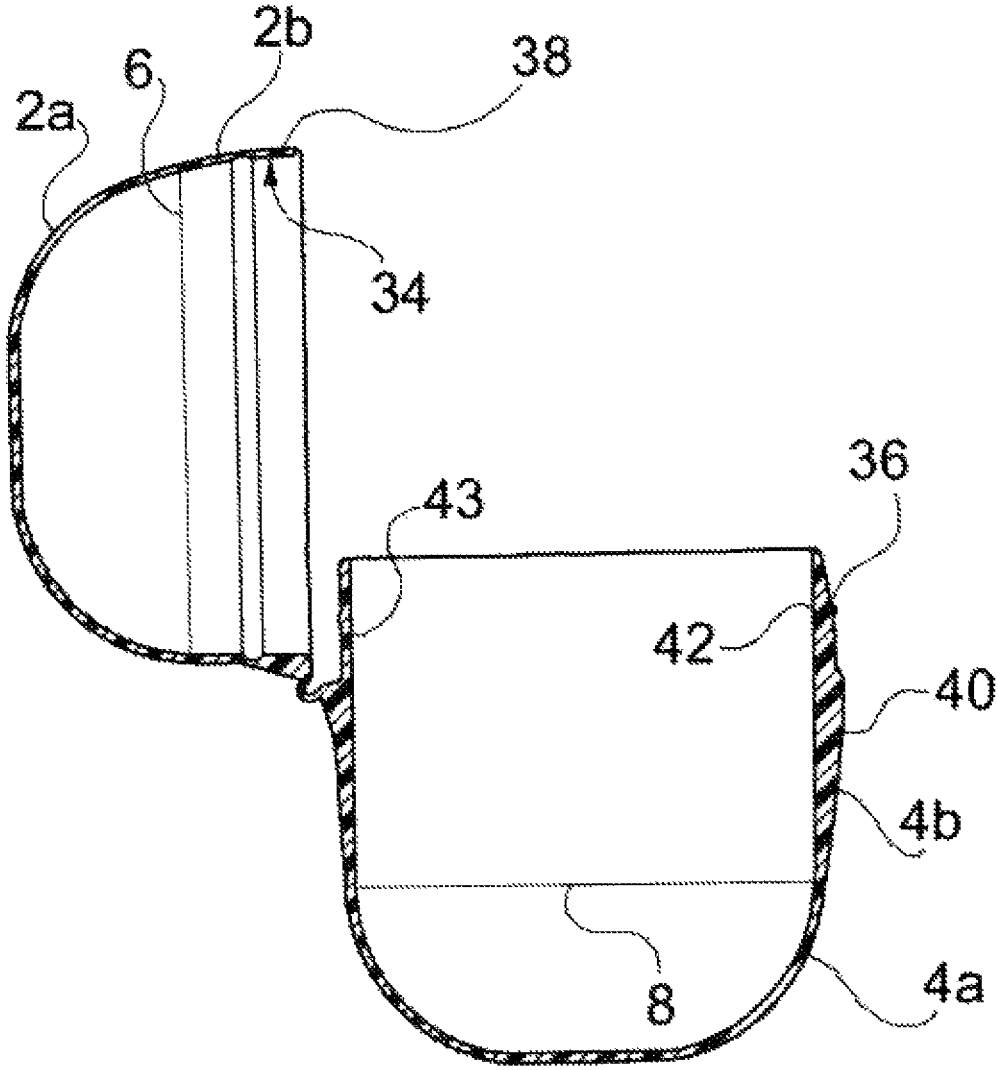
FIG. 5 is a sectioned side view of the container according to FIG. 1, in an open configuration, in which one of the half-shells is tilted through about 90°.

The division between dome-shaped portion and skirt portion is indicated in the cross-section of FIG. 5 by means of the lines 6 and 8; this is, however, a purely ideal division, indicating the possible—but not obligatory—presence of a transition point or region between inner and outer surface portions of the containing wall, with a different curvature, for example a portion with a curved profile in vertical section and a portion with a substantially straight profile or with a smaller curvature.

Considering the optional nature of the abovementioned division, the term "skirt" or "skirt portion" will also be used to indicate the annular wall portion adjacent to the mouth of the respective half-shell.

In the example of embodiment shown, the two half-shells have a mouth, respectively 10 and 12, with a circular contour or—as shown in greater detail below—substantially circular contour.

It is understood, however, that the constructional principle of the invention may also be applied to half-shells with a different contour of the mouth, for example elliptical, oval-shaped, polygonal or mixed-line contour.

The two half-shells can be coupled together mouth-to-mouth in a frontally engaging relationship. In particular, one of the half-shells 4 has a collar 14 able to be inserted or engaged inside a portion of the side wall of the other half-shell 2 (skirt portion 2*b*) with an interfering fit, able to prevent easy release of the two half-shells from each other.

In order to favour a secure connection between the two half-shells, it is possible to envisage form-fitting or snap engaging means comprising, for example, an annular rib 16, in the collar 14, which preferably has an angular or circumferential extension less than 360° (FIG. 6) and may be continuous or discontinuous (in sections) and engages with a complementary annular groove 18 formed on the inner surface of the wall of the other half-shell 2 in the overlapping region of the two half-shells.

It is understood that other engaging means may be used, provided that they are able to ensure a secure connection which, however, can be easily disengaged by the user.

In the embodiment according to FIGS. 1-8, the two half-shells 2 and 4 are connected together by means of hinging means which are integral with the two half-shells and denoted overall by 20.

The present invention is not to be understood as being limited to the choice of a particular type of hinging means and the following description therefore refers to preferred embodiments, which facilitate in particular hinging of the two half-shells and coupling together in the frontally engaging configuration described above.

As shown in FIGS. 2-8, the integral hinging means 20 comprise a film-like hinge element 22 connected to the upper half-shell 2, acting as lid, on the contour of its mouth 10, along a curved segment 24, and to the bottom half-shell 4, immediately underneath the collar 14, along a curved segment 26; at the longitudinal ends (i.e. in the circumferential direction) of the film-like hinge element 22 resilient elements in the form of ribs 28, 30 projecting outwards and having a thickness greater than that of the film-like element 22 are optionally present.

In the closed position of the container, the film-like hinge element 22 and the optional rib-like elements 28, 30 are resiliently flexurally deformed in the manner of a C.

Figure 6:
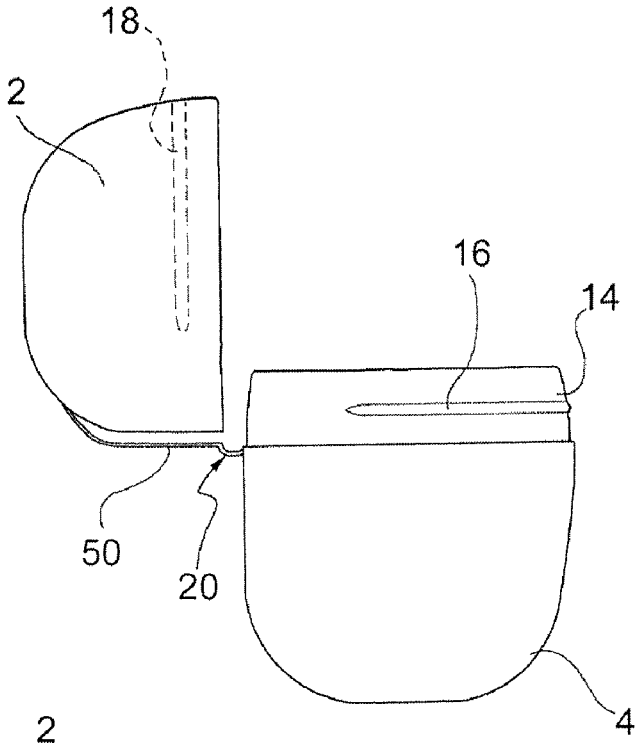
FIG. 6 is a side view of the container according to FIG. 1, in an open configuration, in which one of the half-shells is tilted through about 90° and where shearing of the weakened thickness lines in the upper half-shell has occurred.

Opening of the container from the closed configuration may be performed, by exerting a pulling force upwards on the upper half-shell 2 or by also exerting a compression or a radial squeezing force on the side wall of the container, so as to cause—owing to the flexibility of the container walls—a resilient deformation of this wall which in turn causes the disengagement of the form fit engaging means 16, 18 present in the collar portion 14 and skirt portion 2*b* (FIG. 6).

Following this disengagement, the resilient return force during distension of the film-like hinge element 22 and the optional rib-like elements 28, 30 causes the snap opening of the half-shell 2, with tilting through about 90° about the hinging axis a-a parallel to the plane of the mouth.

In its closed configuration, the container has a substantially cylindrical side wall formed by the skirt portions 2*b* and 4*b* which are connected together; in order to facilitate opening and closing of the container it is preferable, however, that the side wall portion (on the collar 14) which extends circumferentially over an angle $\alpha$, preferably less than or equal to 180°, in the zone facing the hinging means is rounded or curved (with its concavity directed inwards), while the side wall portion which extends over an angle 360°—$\alpha$ in the zone and above the hinging means is cylindrical.

The inner surface of the skirt portion 2*b* of the half-shell 2 thus has—preferably in axial vertical cross-section—a curved profile 34 (FIG. 5) and, correspondingly, the outer surface 36 of the collar 14 has a matching curved profile.

In particular, the container—in its closed configuration—has, in a cross-section along a vertical plane perpendicular to the hinging axis a-a passing through the middle of the hinge 22, in the region on the opposite side to the hinging means 20, a curved or rounded meridian profile and a meridian profile with a straight central portion in the region of the hinging means. It follows that, in the preferred embodiment, both the inner surface 34*a* and the outer surface 38 of the skirt portion 2*b* have a curvature at least in a region thereof with an angular amplitude a situated on the opposite side to the hinging means 20.

Correspondingly, the outer surface 36 of the collar 14 and the outer surface 40 of the skirt portion 4*b* of the half-shell 4 have—in the abovementioned region on the opposite side to the hinging means—a radius of curvature. The inner surfaces 42 of the collar 14 and the skirt portion 4*b* may, however, be substantially cylindrical surfaces.

Preferably, the outer surface 43 of the collar 14 above the hinging means 20 is a cylindrical wall which extends circumferentially, in cylindrical form, over an angle of amplitude 360-$\alpha$, where $\alpha$ generally has a value less than 180°.

It is preferable that the skirt portion 2*b* of the half-shell 2—or at least a circumferentially extending region thereof adjacent to or situated above the hinging means—is flexible or flexurally resilient.

Preferably, the annular wall of the collar 14 is flexible or flexurally resilient; it is preferable, however, that the annular wall of the collar 14 should have a varied rigidity along its circumferential extension, namely that the circumferential region of the annular wall of the collar 14—arranged on the opposite side to the hinging means 20—should be more rigid to flexing or resilient deformation than the circumferential collar region adjacent to or situated above the hinging means and preferably also more rigid than the skirt portion 2*b* of the half-shell 2.

These characteristic features may be obtained by ensuring that at least one region, which extends over an angle α' (where α' may coincide with α), of the annular wall of the collar 14, and optionally of the adjacent skirt portion 4*b*, has a wall thickness greater than the wall thickness of the collar region situated above the hinging means and preferably also greater than the wall thickness of the skirt portion 2*b* of the half-shell 2.

As mentioned above, the wall thickness is preferably limited to a region with an angular extension, α' which extends over an angle less than 360°, for example equal to or less than 180°, on the opposite side to the hinging means 20.

The side wall of at least one of the two half-shells has at least one line with a weakened or reduced wall thickness 44*a*, 46*a*, 44*b* and/or 46*b*, or preferably a pair of these lines arranged adjacent to the ends of the hinging means 20. Preferably, both the half-shells have a pair of the abovementioned weakened thickness lines. The two lines forming the pair extend over a section of the wall of the respective half-shell; the two lines may be parallel with each other or diverge towards the end of the half-shell. In the illustration shown, the two lines—for example 44*a*, 46*a*—are parallel to each other along a first section adjacent to the hinge and diverge along their terminal section which leads onto the dome 2*a*, 4*a* of the respective half-shell.

In the half-shell without the collar (half-shell 2 in FIG. 1), the two lines 44*a*, 46*a* extend from the mouth contour to the dome region.

Figure 1:
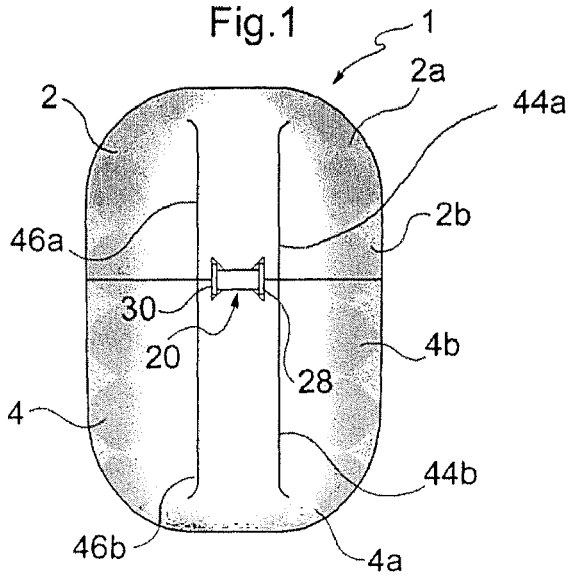
FIG. 1 is a front view of a container according to the invention.
Figure 2:
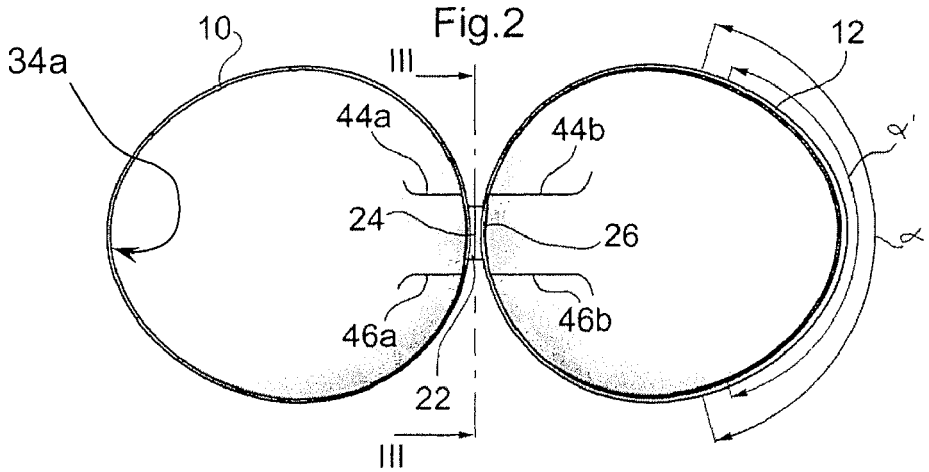
FIG. 2 is a top plan view of the container according to FIG. 1, in a totally open configuration, in which one of the two half-shells is tilted through about 180°.
Figure 3:
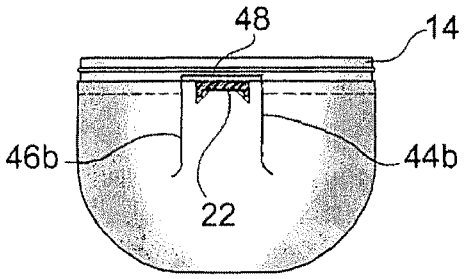
FIG. 3 is a cross-sectional view along the line III-III of FIG. 2.
Figure 4:
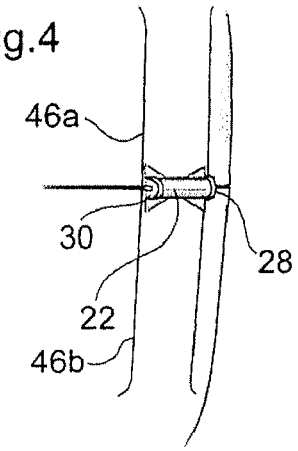
FIG. 4 is an enlarged detailed view of the container according to FIG. 1.

Similarly, in the half-shell with the collar (in the drawings the half-shell 4), the two lines with a weakened thickness 44*b*, 46*b* may extend from the mouth edge of the collar as far as the dome region; alternatively, as shown in FIG. 3, these lines extend over the wall of the half-shell from a zone situated above the hinging means 20 and are connected together by means of a further line with a weakened wall thickness 48 extending circumferentially.

The abovementioned lines with a weakened thickness essentially have the function of preventing or reducing the risk that the—possibly repeated—stresses exerted in order to open and close the container may cause the breakage of the hinging means, with the consequent undesirable separation of the two half-shells.

The mechanical strength properties of the lines with a weakened thickness—and in particular their wall thickness—are regulated depending on the mechanical strength properties of the connecting and hinging means between the two half-shells, in such a way that mechanical (tensile, compressive or twisting) stresses applied to one half-shell or both of them cause firstly the breakage of one or both of the lines with a weakened wall thickness. With breakage of both the lines forming a pair (for example 44*a*,46*a*), the two half-shells remain hinged together by means of the hinging means 20 and by means of the half-shell side wall portion 50 situated between the two sheared weakened thickness lines, in the form of a tongue.

The tongue region 50 which, owing to the flexibility of the side wall of the half-shell, also has optimum flexibility properties acts as an extension of the hinging arm between the two half-shells.

When, in accordance with the preferred embodiment, a second pair of lines with a weakened wall thickness (for example 44*b*, 46*b*) are present on the wall of the other half-shell, the application of further stresses which per se would be prone to cause breakage of the hinging means causes—in a priority manner—the breakage of these lines, resulting in the formation of a tongue region 52 situated between the sheared lines 44*b* and 46*b*. It is understood that breakage of the weakening lines forming the first and second pair may be simultaneous or sequential and that this breakage does not occur necessarily in the time sequence described here by way of example.

Figure 7:
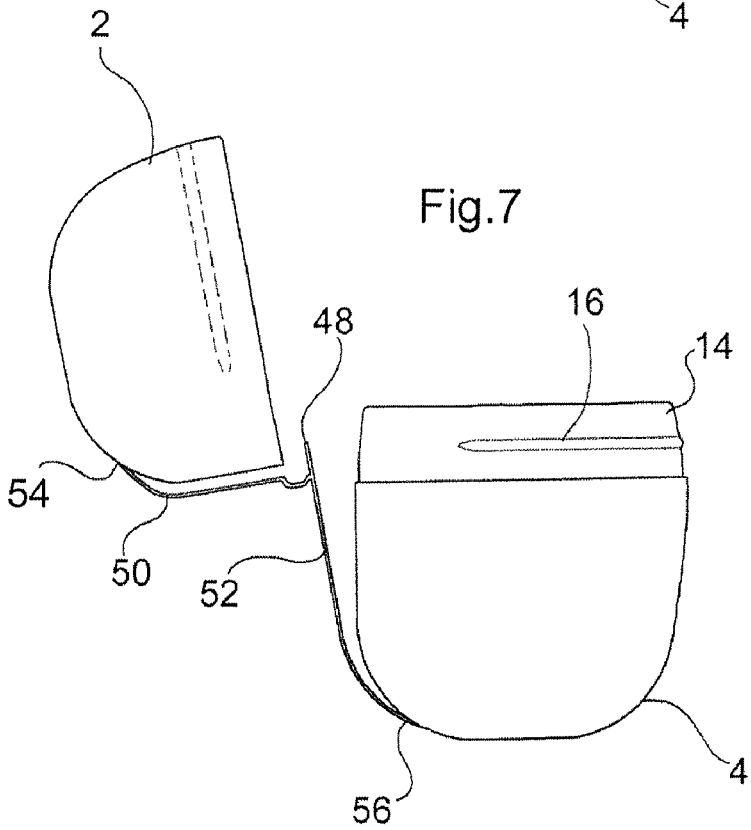
FIG. 7 is a side view of the container, corresponding to FIG. 6, in which shearing of the weakened thickness lines present in both the half-shells has occurred.
Figure 8:
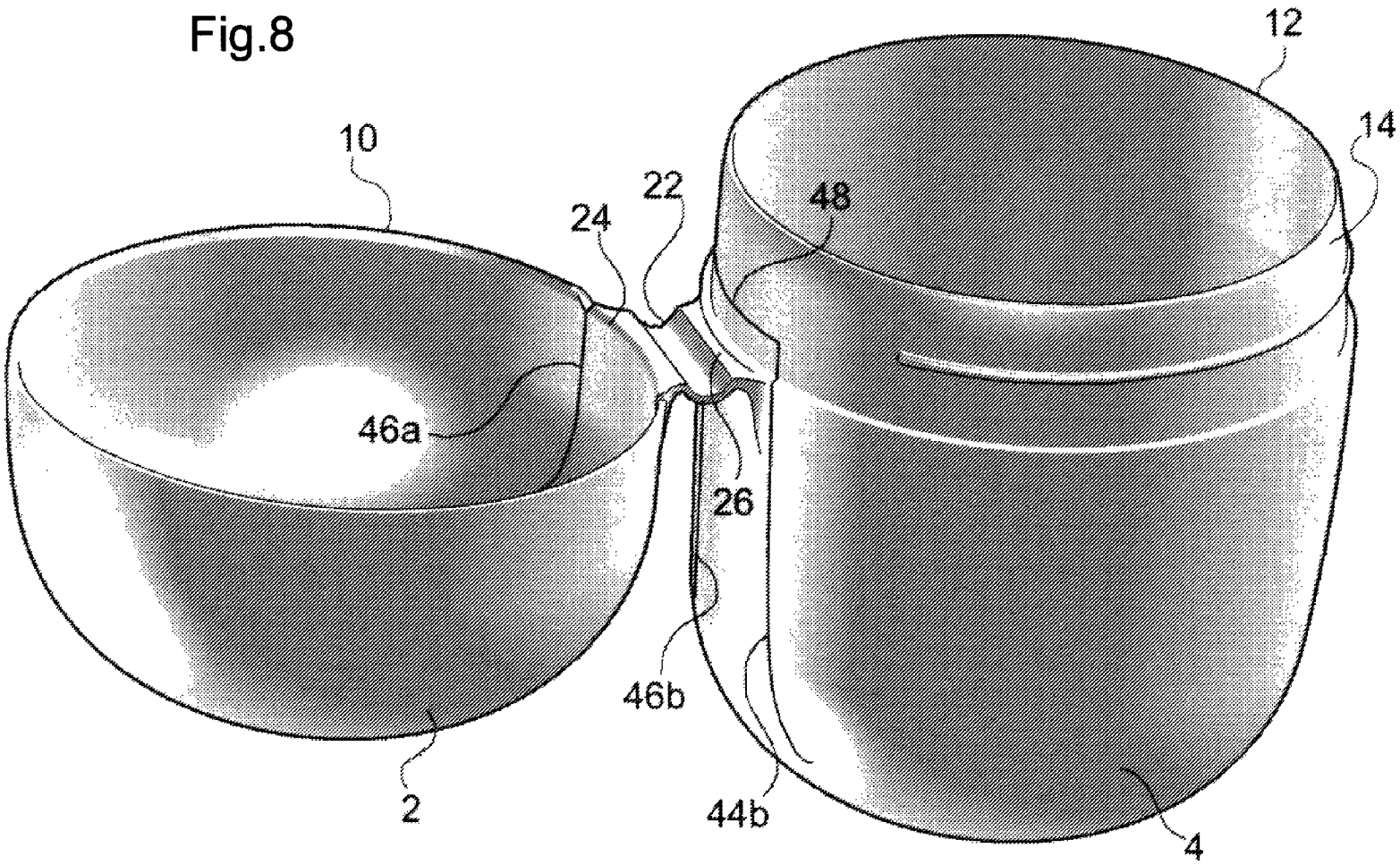
FIG. 8 is a perspective view of a container according to the invention, with one of the half-shells tilted through about 180°.

FIGS. 6 and 7 show respectively a container according to the invention in which breakage of a first pair of the weakening lines (FIG. 6) and both the pairs of weakening lines (FIG. 7) has occurred. It will be noted how the tongues 50 and/or 52, after breakage of the respective weakening lines, are in turn hinged with the body of the respective half-shell, along hinge segments indicated by 54 and 56, respectively, such that breakage of the weakening lines results in formation of further hinging regions of the two half-shells.

Figure 9:
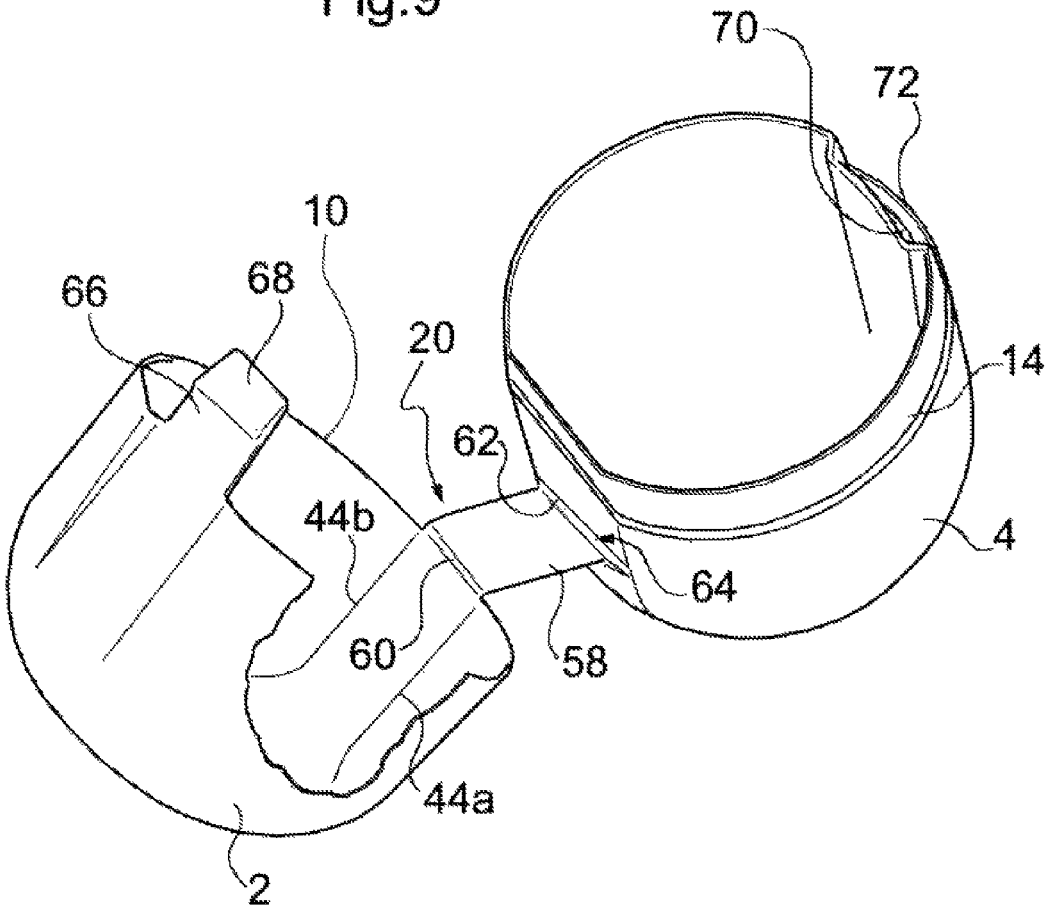
FIG. 9 is a perspective view of another embodiment of a container according to the invention, shown in the open configuration.
Figure 11:
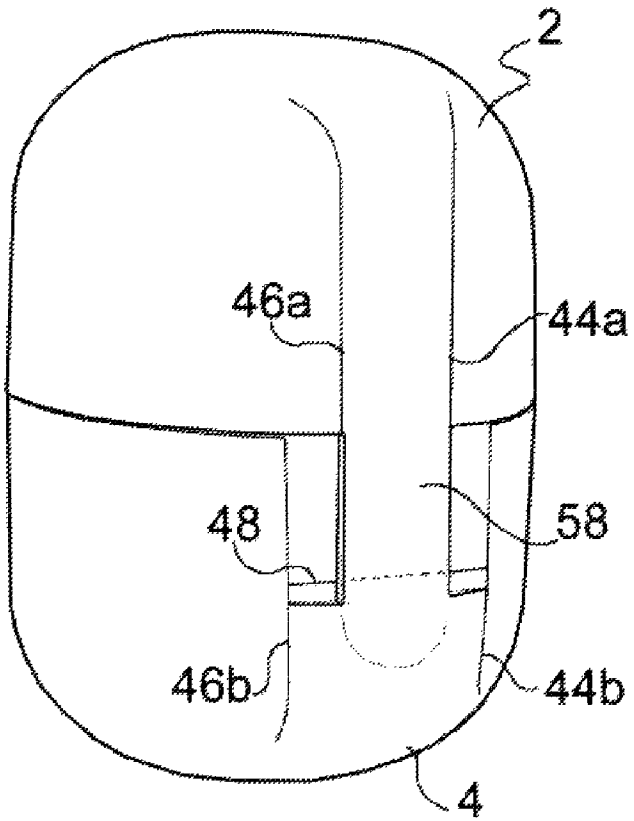
FIG. 11 is a rear view of the container according to FIG. 10.
Figure 10:
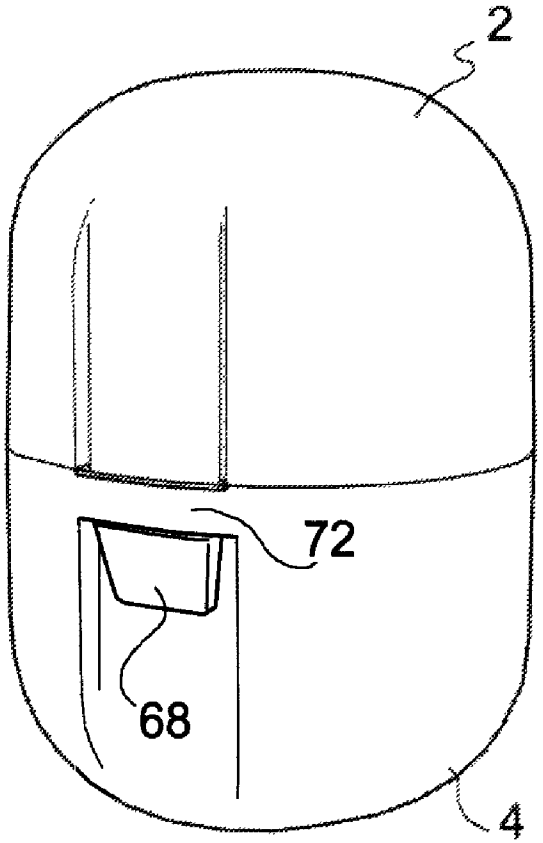
FIG. 10 is a front view of the container according to FIG. 9 in the closed configuration.

In the embodiment described in FIGS. 9-11, the container is formed by two half-shells 2 and 4 which are connected together by means of connecting and hinging means 20 integral with the two half-shells. The connecting and hinging means comprise a tongue element 58 which is connected to a half-shell 2 via a film-like hinge 60 and to the other half-shell 4 via a film-like hinge 62; the connecting means therefore have two hinging axes. The film-like hinge 62 is arranged in a lower position relative to the mouth of the half-shell 4 and underneath the collar region 14; the film-like hinge 60 is arranged along the contour of the mouth of the half-shell 2. The side wall of the half-shell 4 has, opposite the tongue 58, a flattened wall portion 64 against which the hinging tongue 58 is positioned in the closed configuration of the container.

The container has closing/opening means of the bayonet or buckle type, comprising a male element associated with one half-shell and a female element associated with the other half-shell and suitable for engagement with each other. The male element comprises a lug 66 which extends from the edge of a mouth of one of the half-shells and has a radial projection or retaining tooth 68. The other half-shell has, on its side wall, a recess 70 with a substantially flat wall surface with a bridge element 72 which defines, between its radially inner surface and outer surface of the recess, an opening in which in which the end of the lug 66 may be inserted, with the tooth 68 which acts as retaining element for locking the half-shell 2 in the closed configuration of the container.

Opening of the container may be performed by exerting a pressure in the radial direction on the retaining element 68.

In this case also, the wall of one of the half-shells, preferably the wall of the half-shell 2 which is connected to the other half-shell along the contour of its mouth, has preferably two lines with a weakened wall thickness 44*a* and 46*a* of the type described above, arranged in the vicinity of the film-like hinge 60 and outside the latter. It is possible, however, to envisage a second pair of lines with a weakened wall thickness 44*b*, 46*b* (optionally connected together by a transverse weakened thickness line 48) on the other half-shell 4, arranged on the sides of the film-like hinge 62.

Figure 12:
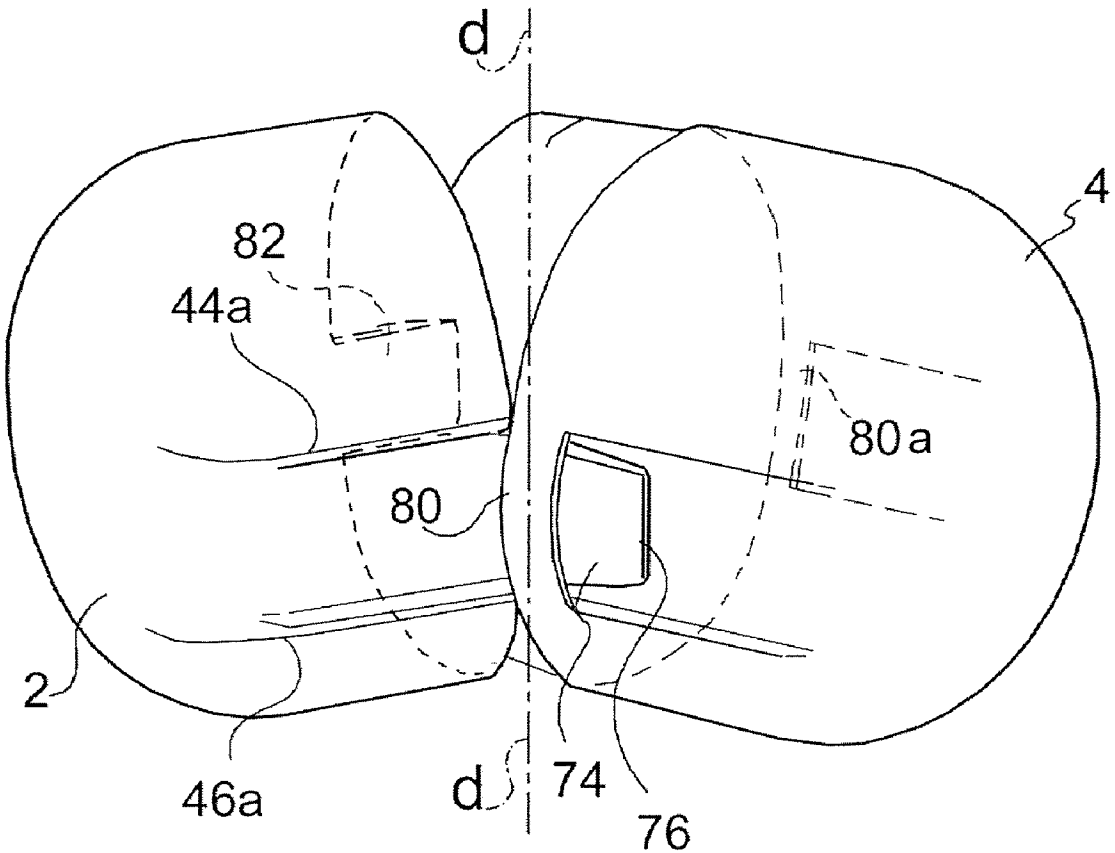
FIG. 12 is a perspective view of another embodiment of the container in the partially open configuration.

In the embodiment according to FIG. 12, the container is formed by two separate half-shells, comprising first bayonet or buckle connecting and hinging means, of the type described above with reference to FIG. 9, which ensure a permanent connection between the two half-shells, and second buckle or bayonet connecting means, which can be easily disengaged so as to allow opening/closing of the container.

The first connecting and hinging means comprise a flexible lug 74 with a radially projecting retaining element 76 which can be inserted inside a recess of the side wall of the other half-shell provided with a bridge element 80 having a retaining element 76 engaging with the bridge element 80.

In this case, owing to the flexibility characteristics of the lug 74, the two half-shells are hinged together by means of a hinge region, with a hinging axis d-d perpendicular to the longitudinal extension of the lug 74.

The second connecting means useful for opening/closing the container are constructionally similar to the first connecting and hinging means described above, with a retaining element 82 engaging with a bridge element 80*a*, having dimensions such as to produce a non-permanent closure and facilitate opening by the user.

In this case also, preferably, weakened wall thickness lines 44*a*, 46*a* are present on the wall of the half-shell 2, adjacent to the ends of the lug 74 of the permanent connecting means.

The container usually has, arranged inside, a gift article intended to be taken out of the container by the user. Owing to the structural characteristics of the container, the two half-shells are kept connected together also following stresses, applied by the user, which per se would be capable of causing breakage of the connecting and hinging means.

It is understood, without modifying the principle of the invention, that the embodiments and the constructional details may be widely varied with respect to that described and illustrated, without departing from the scope of the claims which follow.

Thus, it is understood that other hinging means which differ from those described above and achieve the same functions as those described above may be conveniently used.

Similarly, although the container has been described here with reference to a generally cylindrical configuration, with a substantially circular cross-section, it is understood that the configuration may be varied, by modifying the mouth and wall profile of the two half-shells, for example so as to include a generally oval-shaped configuration formed by two half-shells having an oval-shaped mouth profile or by two half-shells with a circular mouth profile which together, when coupled, form a container with an oval-shaped configuration.

The invention claimed is:

1. Container for products, the container comprising:

two half-shells, with a containing wall and with an open mouth, able to be coupled together mouth-to-mouth so as to form a closed container; and a hinging means connecting the two half-shells together, the hinging means having a hinging axis such as to allow the movement of one of the half-shells with respect to the other one between a closed position of the container and an open position;

wherein the container, in its closed configuration, has a minimum overall dimension of between 20 mm and 55 mm;

wherein the containing wall of at least one of the half-shells has, in the vicinity of the hinging means, at least one line with a weakened wall thickness, which extends over a section of said wall and which is capable of breakage following stresses applied to at least one of the half-shells and/or to the hinging means connecting the two half-shells;

wherein, in the absence of said line with a weakened wall thickness, said stresses would cause breakage of said hinging means;

wherein said at least one weakened wall thickness line has a thickness such that it is prone to breakage before breakage of the hinging means which connect the two half-shells; and wherein the container is capable of being in the open position with said at least one weakened wall thickness line unbroken.

2. Container according to claim 1, characterized in that at least one of the half-shells, or preferably both the half-shells, have a pair of weakened wall thickness lines which extend over a wall section of the respective half-shell, each near a lateral end of said hinging means.

3. Container according to claim 2, characterized in that the two weakened wall thickness lines forming each pair, are parallel to each other or diverge from each other, towards a terminal portion of the respective half-shell.

4. Container according to claim 2, characterized in that the weakened wall thickness lines forming said pair define between them a containing wall element of the respective half-shell in the form of a tongue which, following breakage of said lines, connects the containing wall of the respective half-shell to the hinging means.

5. Container according to claim 1, characterized in that the hinging means which connect together the two half-shells are integral with the two half-shells.

6. Container according to claim 1, characterized in that said hinging means comprise at least one film-like hinge.

7. Container according to according to claim 1, characterized in that the hinging means comprise a flexible film-like hinge element connected to the wall of both the half-shells along curved segments.

8. Container according to according to claim 1, characterized in that one of said half-shells has a containing wall portion forming a collar which can be engaged inside a portion of the containing wall of the other half-shell and in which the two half-shells are connected together by means of a flexible film-like hinge element connected to one of the said half-shells along or flush with a contour of its mouth and to the containing wall of the other half-shell underneath said collar portion.

9. Container according to claim 8, characterized in that said half-shell, provided with a collar, has a pair of weakened wall thickness lines which extend along the containing wall of said half-shell from the contour of its mouth or from a level a few mm lower than an edge of its mouth and in which the other half-shell also has a pair of weakened wall thickness lines which extend from the contour of its mouth.

10. Container according to claim 8, characterized in that said half-shell, provided with a collar, has a pair of weakened wall thickness lines which extend along the containing wall of said half-shell from a region of the collar, wherein said pair of lines is connected together by another weakened wall thickness segment which extends circumferentially in the region of the collar between said pair of weakened wall thickness lines.

11. Container according to claim 1, characterized in that said hinging means comprise a flexible tongue element connected to a contour of the mouth of a half-shell by means of a film-like hinge element and to the wall of the other half-shell by means of a second film-like hinge element.

12. Container according to claim 11, characterized in that said half-shells have closing means of a bayonet or buckle type comprising a male element associated with one half-shell and a female element associated with the other half-shell and able to be engaged together, said closing means being able to be disengaged by a user.

13. Container according to claim 1, wherein said hinging means are formed as a bayonet or buckle connecting and hinging means comprising: a male element, provided on one half-shell, in the form of a flexible lug provided with a retaining element, and a female element, which is provided on the other half-shell and inside which said male element can be engaged in a form-fitting manner, said connecting and hinging means being able to produce a permanent connection between the two half-shells.

14. Container according to claim 13, characterized in that said half-shells further comprise a second bayonet or buckle connecting means, able to be engaged with each other and disengaged by a user in order to open the container.

15. Container according to claim 1, characterized in that one of the half-shells comprises a collar which can be inserted with engagement inside the other half-shell and where said collar has a varied wall thickness along its circumferential extension, with a wall thickness in its region (α') facing the hinging means greater than the wall thickness of its region adjacent to or situated above the hinging means.

16. Container according to claim 1, characterized in that in its closed configuration it has a curved containing side wall portion which extends angularly (α) in a zone facing the hinging means and a containing side wall portion which extends angularly (360-α) in the zone surrounding the hinging means.

17. Container according to claim 16, characterized in that in its closed configuration it has a curved meridian profile in a region of angular extension (α), in the zone facing the hinging means, and a meridian profile with a straight central portion in a region surrounding the hinging means.

18. Container according to claim 1, characterized in that said half-shells have flexible containing walls capable of resilient deformation, such that a radial compressive force exerted on the side wall of at least one of the two half-shells, able to cause resilient crushing thereof when the container is closed, is capable of causing snap opening of the container.

19. Container according to claim 1, characterized in that the container is made of a plastic chosen from among polyethylene, polypropylene homopolymer or copolymer, polyamide and polyethylene terephthalate.

20. Food product package including a container according to claim 1, in which a toy article or a food product is contained.

* * * * *